United States Patent [19]

Cocco et al.

[11] 4,307,955

[45] Dec. 29, 1981

[54] PROCESSING APPARATUS FOR INSTANT TYPE TRANSPARENCY FILM

[75] Inventors: Vincent L. Cocco, Wakefield; Richard R. Wareham, Marblehead, both of Mass.

[73] Assignee: Polaroid Corporation, Cambridge, Mass.

[21] Appl. No.: 216,266

[22] Filed: Dec. 15, 1980

[51] Int. Cl.[3] ..... G03D 5/06

[52] U.S. Cl. ..... 354/303; 354/313; 354/318

[58] Field of Search ..... 354/83, 84, 85, 86, 354/87, 301, 303, 305, 313, 314, 317, 318, 304, 211

[56] References Cited

U.S. PATENT DOCUMENTS

| | | | |
|---|---|---|---|
| 2,848,931 | 8/1958 | Troidl | 354/318 |
| 2,880,657 | 4/1959 | Bartlett . | |
| 3,563,486 | 2/1971 | Mortsel et al. | 354/313 |
| 3,640,204 | 2/1972 | Gordon | 354/318 |
| 3,667,361 | 6/1972 | Meggs et al. | 354/318 |
| 3,680,462 | 8/1972 | Cronig | 354/317 |
| 4,167,318 | 9/1979 | Wareham | 354/298 |
| 4,200,383 | 4/1980 | Bendoni et al. | 354/304 |

OTHER PUBLICATIONS

Research Disclosure Apr., 1980 pp. 132–134.

*Primary Examiner*—L. T. Hix
*Assistant Examiner*—Alan Mathews
*Attorney, Agent, or Firm*—Alfred E. Corrigan

[57] ABSTRACT

Apparatus including a housing and a disposable film processing kit for processing an exposed roll of instant or self-developing type transparency film. The kit includes a roller supporting a coiled length of sheet material, a drum having one end of the sheet material attached thereto, and a processing composition dispenser located therebetween. The kit is adapted to be inserted into the housing, and an end of an exposed strip of film is threaded across a sprocket wheel and directed towards the drum. The sprocket wheel and the drum are driven in a direction so as to wind the film and sheet material upon the drum with a layer of the processing composition located therebetween. The drum is provided with a single resiliently mounted projection which is adapted to enter a sprocket hole in the film to facilitate the movement of the end of the film to a position between the spreader sheet and the drum.

7 Claims, 4 Drawing Figures

PROCESSING APPARATUS FOR INSTANT TYPE TRANSPARENCY FILM

BACKGROUND OF THE INVENTION

1. Field of the Invention

This invention relates to apparatus including a housing and a disposable film processing kit for processing an exposed roll of instant type transparency film.

2. Description of the Prior Art

The present invention relates to apparatus for processing, i.e., producing visible images, an exposed roll of self-developing or instant type transparency film, preferably of the type which is adapted for use in conventional 35 mm cameras, vis-a-vis self-developing or instant type cameras. More specifically, the apparatus includes a disposable processing kit which is adapted to be placed as is, into a housing which, in turn, is also adapted to locate an exposed roll of 35 mm film in position such that the film may be driven into the kit and wound upon a drum in superposition with a length of sheet material having a gel coated surface. Prior to superposing the film and sheet material, a layer of processing composition is coated on the sheet material. The film and sheet material remain coiled on the drum with the layer of processing composition therebetween until the latent images in the film have been substantially developed. Thereafter, the film is stripped from the sheet material and directed to the exterior of the apparatus where it may then be cut and mounted in suitable frames for subsequent use in a viewer and/or projector.

Broadly, the concept of providing apparatus for developing an exposed roll of instant type transparency film of the type adapted for use in conventional 35 mm cameras is disclosed in U.S. Pat. Nos. 4,167,318 and 4,200,383 and on pages 132–134 of RESEARCH DISCLOSURE, dated April, 1980.

The film assemblages disclosed in the RESEARCH DISCLOSURE article basically include a cylindrically shaped film cassette, a supply of instant type transparency film, and a supply of processing composition located within the film cassette. The film in these assemblages is adapted to be processed in apparatus taking the form of a conventional 35 mm camera in which the film was exposed. After the film has been almost totally withdrawn from the film cassette during the exposure thereof, it is rewound into the film cassette and during such rewinding, a container (or a plurality of containers) of the processing composition is ruptured by a lip located adjacent to the film withdrawal slot in the cassette and its contents spread between superposed sheets of the film. Disadvantages with these types of film assemblages are many and include (1) a limit on the length of film that may be wound within the film cassette due to the volume occupied by the processing composition, (2) the shelf life of the assemblage is a function of the shelf life of the film or that of the processing liquid, whichever is the shorter, vis-a-vis an assemblage which does not contain the processing composition as a part thereof, and (3) an additional limit is placed upon the length of film that may be accommodated by the cassette because the film is apparently comprised of two lengths of superposed film.

The apparatus disclosed in U.S. Pat. No. 4,167,318 includes a pair of sprocket wheels, the projections of which are adapted to enter the sprocket holes in the film being processed. If, for any reason, one of the projections should not enter a sprocket hole in the film during advancement of the film, it is possible that the film may be damaged. For example, if a projection were to move into engagement with the film at a point intermediate two sprocket holes, it may penetrate the film and cause a laterally extending tear in the film, or it may raise the film such that it becomes partially or totally disengaged from the associated sprocket wheel. Further, the apparatus disclosed in U.S. Pat. No. 4,167,318, as well as that disclosed in U.S. Pat. No. 4,200,383, is not adapted to strip the layer of film containing the processed positive visible image of the transparency from the remainder of the film structure. Accordingly, the finished product is one in which a greater amount of light must be directed through the transparency in order to get a projected image having an illumination equal to that wherein the transparency does not include the emulsion layer and/or residual processing composition.

U.S. Pat. No. 2,880,657 shows apparatus in the form of a camera-projector which is provided with means for processing an exposed photosensitive sheet by superposing the photosensitive sheet with a second sheet and spreading a thin layer of processing composition between the superposed sheets as they are being wound upon a rotating drum. The photosensitive and second sheets are maintained upon the drum in superposition with the layer of processing composition interposed therebetween for a predetermined processing period during which visible images are produced in one of the sheets, preferably in the second sheet. At the end of this predetermined period of time, the second sheet is stripped from the photosensitive sheet, advanced past a projector such that the images therein may be viewed, and then wound upon a take-up spool. However, this apparatus does not lend itself to the processing of 35 mm instant type film, which film is packed in film cassettes which are adapted to be exposed outside the processing apparatus, i.e., in conventional 35 mm cameras.

SUMMARY OF THE INVENTION

The instant invention relates to apparatus including a disposable processing kit and a housing in which the kit is adapted to be positioned so as to process a roll of exposed instant type transparency film, preferably of the 35 mm format. The housing defines a lighttight chamber which is adapted to receive a film cassette containing a roll of 35 mm instant transparency film. The film cassette is configured so as to be readily loaded into a conventional camera of the 35 mm type and includes an exit slot extending from a main cylindrically shaped body and through which an end of the exposed film is adapted to extend to the exterior of the film cassette. An AC and/or DC powered motor is mounted within the housing and is adapted to drive a sprocket wheel through a power train in a first direction so as to withdraw a major length of the exposed film from the film cassette. Suitable means, e.g., a mechanical switch, is mounted within the housing for detecting when the last exposed frame in the film has been withdrawn from the cassette and terminating the flow of energy to the motor. A knife is mounted within a cover of the housing and is adapted to cooperate with an anvil within the main body of the housing to sever a trailing end portion of the film so as to free it from its attachment to the film spool located within the film cassette. The disposable kit is adapted to be purchased at a store and placed, preferably, as is within the housing. The kit includes suitable materials for processing one roll of exposed film. These materials include a length of sheet material which is coiled about a rotatably mounted roller and a supply of processing composition which is located within a dispenser and which is adapted to be coated upon a gel coated surface of the sheet material as the latter is advanced past the dispenser. Also rotatably mounted within the kit is a drum. The drum is coupled to a drive member which, in turn, is in driving engagement with the aforementioned power train when the kit is properly located within the housing. One end of the sheet material is secured to the surface of the drum and its opposite end is secured to the roller. A top wall of the kit has an opening therein through which a leading end section (leader) of the film is adapted to be advanced into the kit to a position between the spreader sheet and the surface of the drum. To facilitate the advancement of the leading end of the film, a sprocket tooth or projection is resiliently coupled to one side of the drum. The resilient connection allows the film to move the tooth into a non-driving position whenever the tooth misregisters with one of the sprocket holes or apertures in the film. When located in the non-driving position, it cannot harm the overlying film by causing it to dimple or tear.

With the kit and exposed roll of film properly located within the housing and the latter secured so as to render it lighttight, the sprocket wheel and drum are rotated so as to simultaneously withdraw the film from its cassette and the sheet material from its roller and coil them about the rotating drum in superposition. Initial movement of the sheet material is effective to rupture a seal on the dispenser such that it then applies a coating of processing composition to the sheet material prior to it being superposed with the film. The drive to the sprocket wheel and the drum is terminated after the last frame in the film has been withdrawn from the cassette and superposed with the sheet material upon the drum with a coating of processing composition located therebetween. After a predetermined period of time, e.g., one minute, the trailing end of the film is severed and the aforementioned switch reset. The motor is now driven in an opposite direction thereby causing the severed end of the film to be guided toward an exit slot in the housing while the sheet material is rewound automatically upon its roller. The cover of the housing may now be opened, the kit removed and properly discarded and the processed film cut and mounted for subsequent viewing.

An object of the invention is to provide in apparatus for processing an exposed roll of instant type transparency film, improved means for withdrawing the exposed film from its cassette and superposing it with a sheet material having a coating of processing composition thereon.

Another object of the invention is to provide apparatus of the type described with resiliently mounted drive means for entering the sprocket holes in the exposed film during advancement of the latter into superposition with the coated sheet material.

Still another object of the invention is to provide a disposable kit for use with a housing in the processing of an exposed roll of instant transparency type 35 mm film.

Still another object of the invention is to provide a kit of the type described with all of the materials necessary to process an exposed roll of instant type transparency film.

Other objects will in part be obvious and will in part appear hereinafter.

The invention accordingly comprises the apparatus possessing the construction, combination of elements and arrangement of parts which are exemplified in the following detailed disclosure, and the scope of the application of which will be indicated in the claims.

BRIEF DESCRIPTION OF THE DRAWINGS

For a fuller understanding of the nature and objects of the invention, reference should be had to the following detailed description taken in conjunction with the accompanying drawings wherein.

DETAILED DESCRIPTION OF THE INVENTION

Figure 1:
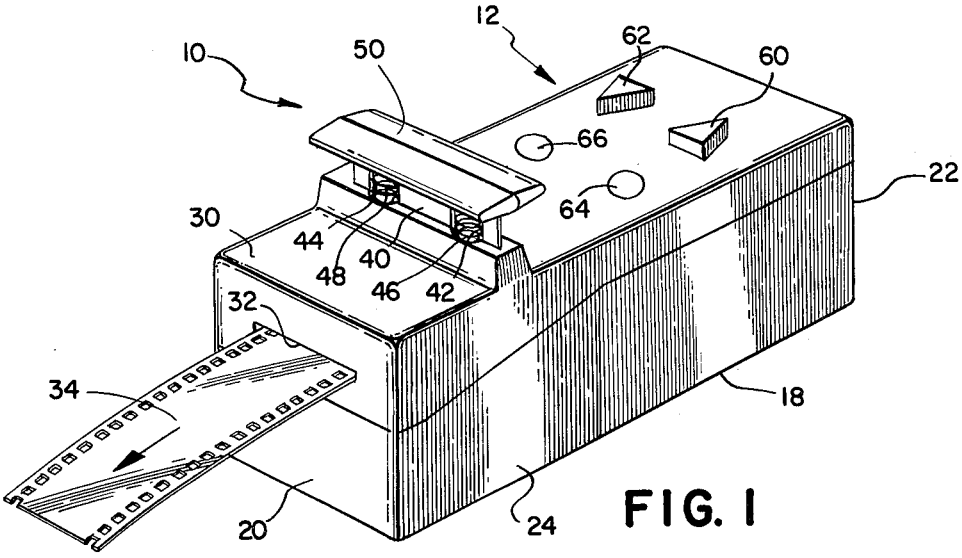
FIG. 1 is a perspective view of apparatus incorporating the instant invention.
Figure 2:
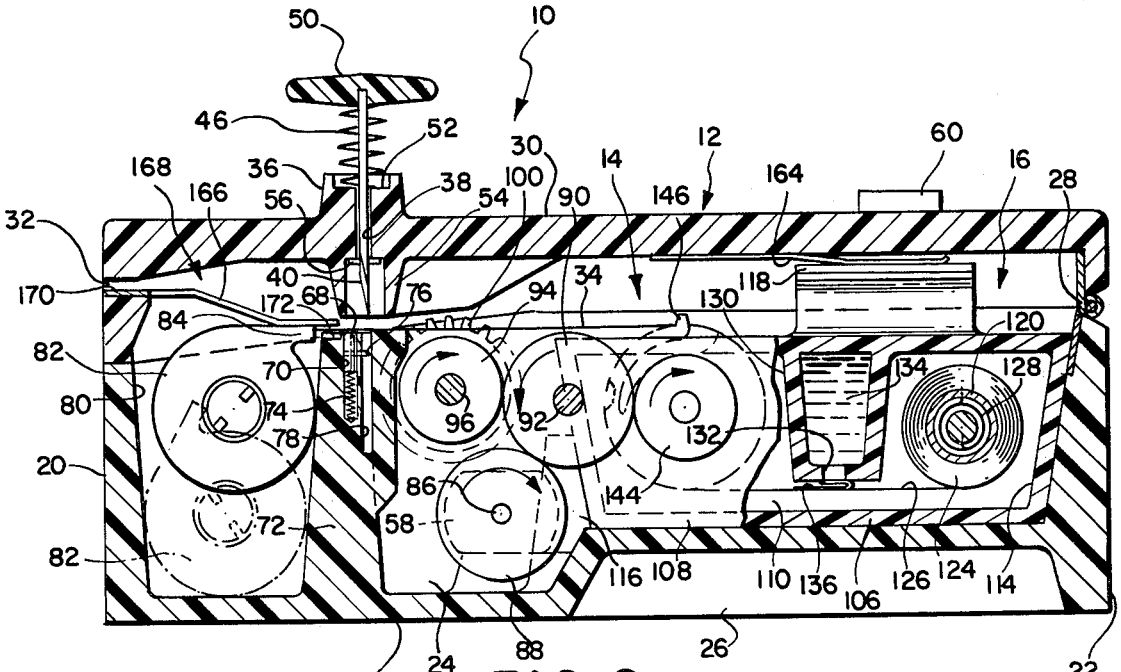
FIG. 2 is a side elevational view, partly in section, of the apparatus shown in FIG. 1.
Figure 3:
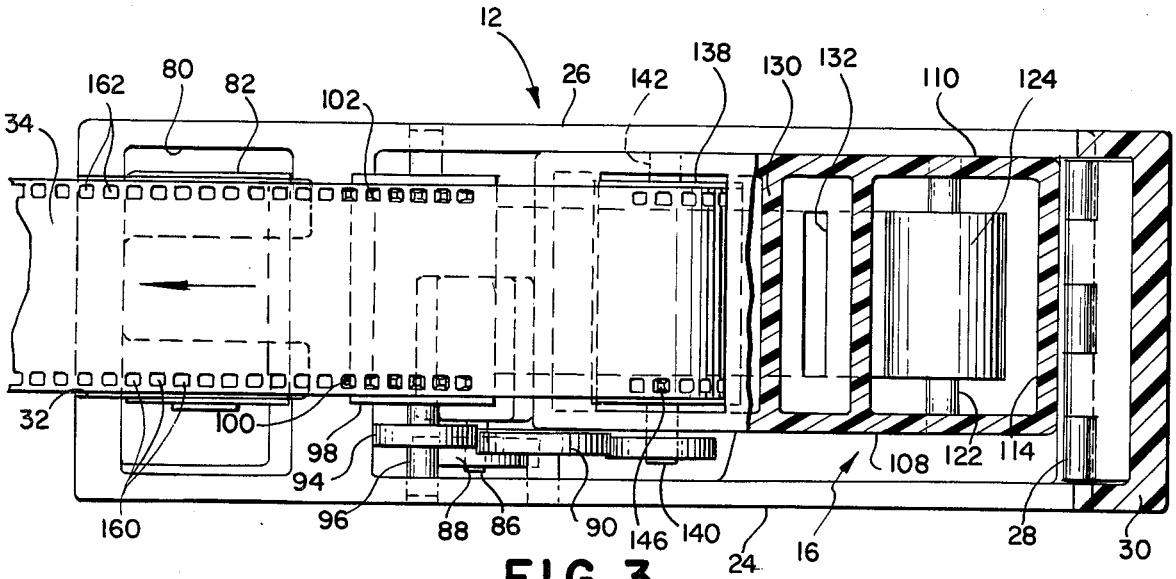
FIG. 3 is a top elevational view, partly in section, of the apparatus of FIG. 1 with its cover or loading door shown in an open position.

Reference is now made to the drawings, and in particular to FIGS. 1–3 wherein is shown an apparatus 10 for processing an exposed roll of instant or self-developing type transparency film, preferably of the 35 mm format. The apparatus 10 includes a housing 12, which defines a lighttight chamber 14, and a disposable film processing kit 16 (see also FIG. 4), which is adapted to be purchased at a store and placed, as is, into the housing 12 such that it occupies the position shown in FIG. 2.

The housing 12 includes a main body defined by a bottom wall 18, a pair of end walls 20 and 22, and a pair of side walls 24 and 26. The top of the end wall 22 is provided with a hinge 28 for pivotally coupling a top wall or loading door 30 to the end wall 22. An elongated slot 32 is located in the opposite end of the loading door 30. The slot 32 is dimensioned to permit the passage therethrough of an elongate strip of film 34, and is provided with suitable light blocking means (not shown), such as flocking, so as to preserve the lighttight integrity of the chamber 14 when the loading door 30 is in the position shown in FIG. 1. The loading door 30 includes an upstanding boss 36 which extends between the side walls 24 and 26 and includes an elongate recess 38 which provides a means for mounting an elongate blade 40. The blade includes two openings 42 and 44 in which are located a pair of springs 46 and 48. The springs 46 and 48 are trapped between the underside of a handle 50 attached to the top of the blade 40 and a recessed portion 52 in the boss 36. The underside of the loading door 30 includes a recessed boss 54 in which the bottom of the blade 40 is normally maintained by the bias of the springs 46 and 48 and by a stop pin 56 which extends from each face of the blade 40, as best seen in FIG. 2, thereby protecting the operator from the blade 40 when the loading door 30 is in the open position.

The apparatus 10 includes an electrical circuit (not shown) for connecting a motor 58, mounted in the main body to a source of energy. The circuit includes manually actuatable switches 60 and 62 and indicator lights 64 and 66. The circuit also includes a normally open switch 68 located in series with the switch 60 and the motor 58. The switch 68 is mounted within a recess 70 in a partition 72 which extends upwardly from the bottom wall 18 of the main body of the apparatus 10. The switch is biased upwardly into its normally open position by a spring 74 which is also mounted in the recess 70. Vertical upward movement of the switch is limited by a pin 76 engaging the top of a vertical slot (not shown) which is located in the left-hand wall, as viewed in FIG. 2, of a recess 78. The pin 76 is an integral part of the switch 68. The maximum upward location of the switch 68 is slightly above that shown in FIG. 2.

Referring back to the main body of the apparatus 10, it can be seen in FIG. 2 that the partition 72 cooperates with the end wall 20 to define a compartment 80 for receiving a film cassette 82 which has an exit opening 84 through which the film 34 is adapted to be withdrawn during exposure in a camera and during processing in the apparatus 10. The film cassette 82 has a configuration similar to that of the conventional 35 mm film cassettes on the market today, and has a diameter less than the distance between the facing surfaces of the end wall 20 and the partition 72 such that it may drop into the dotted line position shown in FIG. 2 upon severance of the film 34 by the blade 40, as will be more fully explained hereinafter.

The output shaft 86 of the motor 58 is fixedly secured to a friction wheel 88 which, in turn, is located in driving engagement with a friction wheel 90. A shaft 92 of the friction wheel 90 is rotatably supported by the side wall 24 of the apparatus 10. The friction wheel 90 is, in turn, in driving engagement with a friction wheel 94 fixedly mounted on one end of a shaft 96, the opposite ends of which are rotatably supported by the side walls 24 and 26. Fixedly mounted on the shaft 96 is a cylinder 98 having a set of sprocket teeth 100 and 102 extending around the entire circumference of each end of the cylinder 98.

Figure 4:
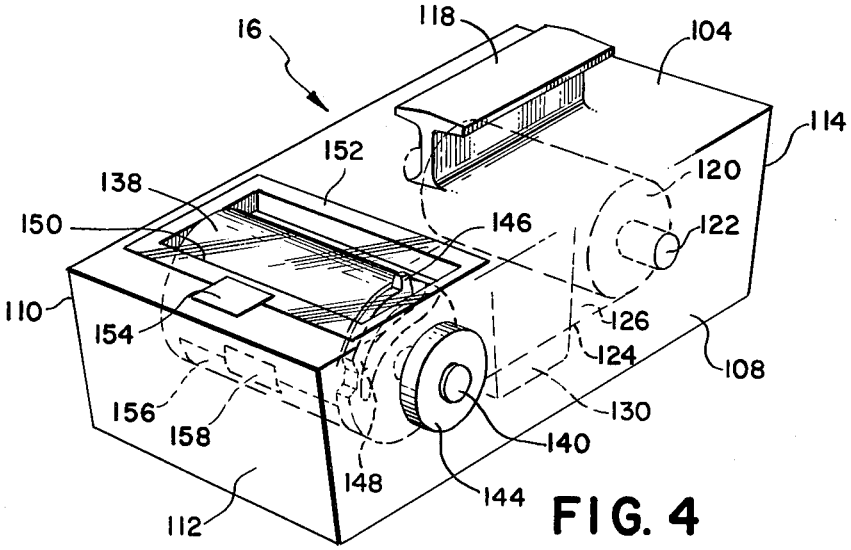
FIG. 4 is a perspective view of a disposable processing kit which comprises a portion of the apparatus shown in FIGS. 1–3.

As mentioned hereinabove, the housing 12 is adapted to receive the disposable processing kit 16. As best seen in FIGS. 2 and 4, the kit 16 includes a housing defined by top and bottom walls 104 and 106, side walls 108 and 110, and end walls 112 and 114 which taper towards each other as they connect the top wall 104 to the bottom wall 106. This taper of the end walls 112 and 114 together with the taper of the inside surface of the end wall 22 of the main body and a tapered partition 116 which extends upwardly from the bottom wall 18 facilitates the proper positioning of the kit 16 into the main body of the housing 12, as best shown in FIG. 2. A handle 118 extends upwardly from the top wall 104 and is used to facilitate the removal of the kit 16 from the housing 12.

A roller 120 is rotatably supported within the kit 16 by an axle 122 which has its opposite ends fixedly secured within the side walls 108 and 110. An elongate sheet of material 124 having a gel (gelatin) coated surface 126 is coiled about the roller 120 with one of its ends fixedly attached to the roller 120. A coil spring 128 (see FIG. 2) has one of its ends secured to the roller 120 and its other end secured to the axle 122. The spring 128 is adapted to be tensioned during clockwise rotation of the roller 120 so as to provide a biasing force for rewinding the sheet material 124 upon the roller 120, as will be further explained hereinafter.

Molded integrally with and extending downwardly from the top wall 104 of the kit 16 is a dispenser 130 having a nozzle 132 which is adapted to apply a coating of processing composition 134 across the entire width of the gel coated surface 126 of the sheet material 124 as the latter is advanced past the nozzle 132. A tape 136 has one of its ends fixedly secured to the sheet material 124 and its other end releasably secured in sealing relation to the nozzle 132.

Also mounted within the kit 16 is a drum 138. The drum 138 includes a pair of journals 140 and 142 which are rotatably supported by the side walls 108 and 110, respectively, of the kit 16. The journal 140 extends through the side wall 108 and has a friction wheel 144 fixedly attached at its end, as best seen in FIGS. 3 and 4. A projection or sprocket tooth 146 is resiliently connected to the drum 138 by a living hinge in the form of an arm 148. As the drum 138 is rotated through 360°, the projection rotates to a position exterior of the kit 16 via a rectangular opening 150 located in the top wall 104. The opening 150 is temporarily sealed by a sheet of clear plastic 152 having a small aperture therein for receiving the projection 146 so as to secure the drum 138 in the position shown in FIG. 4. A tab 154 extends from the sheet 152 and is adapted to be grasped and pulled by the user so as to remove the sheet 152. This may take place after the kit 16 has been placed in the main body of the housing 12. The drum 138 is adapted to be driven in a clockwise manner so as to wrap the sheet material 124 thereupon. Accordingly, the free end 156 of the sheet material 124 is secured to the drum 138 by a piece of tape 158.

As stated hereinbefore, the apparatus 10 is adapted to process an exposed roll of instant type transparency film 34 of the 35 mm format. The film 34 preferably includes a plurality of layers including, in sequence, (1) a transparent base which is adapted to face the lens of a camera and through which an exposure is made, (2) an additive color screen, (3) an image receiving layer, (4) a stripping layer, (5) a photosensitive layer (emulsion layer), and (6) a gelatin layer.

In the operation of the apparatus 10, the kit is positioned within the main body of the housing 12, as shown in FIG. 2, and the protective sheet 152 is stripped therefrom by pulling on the tab 154. Next, the film cassette 82 is placed in the compartment 80 and the end of the film is placed across the cylinder 98 such that (1) the sprocket teeth 100 and 102 are in register with the apertures 160 and 162 located along the sides of the film 34, (2) the sprocket tooth or protrusion 146 is in register with one of the apertures 160, and (3) the end of the film is turned downwardly into the kit 16 via the opening 150 to a position between the drum 138 and the dispenser 130. The loading door 30 is then moved into the closed position, shown in FIG. 2, thereby moving a spring 164 on the loading door 30 into engagement with the handle 118 of the kit 16 to bias the friction wheel 144 into firm engagement with the friction wheel 90. The closing of the loading door 30 also moves the legs 166 (only one shown) of a U-shaped guide member 168 into engagement with the film cassette 82. The legs 166 extend upwardly toward the exit slot 32 wherein the base 170 is fixedly secured. At this point, it should be noted that the width of the compartment 80 near its top is greater than the diameter of the film cassette 82 and that the latter is maintained in the position shown by the tension in the film overlying the cylinder 98 and drum 138. The mechanical switch 68 is then unlatched by any suitable means, e.g., by a lever extending to the exterior of the apparatus 10 so as to enable the spring 74 to lightly bias the switch 68 into engagement with one side of the overlying film 34. So positioned, the switch 68 is still in a closed or conductive position.

The processing of the film 34 is initiated by depressing the switch 60 thereby coupling the motor 58 to its source of energy to drive the friction wheels 88, 92, 94 and 144 in the directions shown by the arrows in FIG. 2 and to illuminate the indicator 64 thereby indicating to the user that the film 34 is being withdrawn from the film cassette 82. Clockwise rotation of the friction wheels 94 and 144 is effective to rotate the cylinder 98 and its associated sprocket teeth 100 and 102 and the drum 138 and its associated sprocket tooth 146 in a direction to advance the leading end of the film 34 to a position wherein it is trapped between the sheet material 124 being wound upon the drum 138 and the surface of the drum itself. Also, as the drum 138 rotates in a clockwise direction, it withdraws the sheet material 124 from the roller 120, which action, in turn, strips the tape 136 from sealing engagement with the nozzle 132 thereby enabling the latter to lay a continuous coat of processing composition 134 on the gel coated surface 126 of the sheet material 124 as it is being advanced toward the drum 138. With the end of the film 34 trapped as described, further clockwise rotation of the drum 138 is effective to simultaneously withdraw the film 34 from its cassette 82 and the sheet material 124 from the roller 120 and wrap them in superposition upon the drum 138 with a coating or layer of the processing composition 134 located between the gel coated surface 126 of the sheet material 124 and the layer of the film 34 most remote from that through which the film 34 was originally exposed. If, during this time, the sprocket tooth or projection 146 should become misregistered with one of the sprocket holes 160 in the film 34, i.e., engage the film 34 at a location intermediate two adjacent sprocket holes 160, the tension in the overlying film will automatically move the projection 146 in a clockwise direction, as viewed in FIG. 2, into a non-driving position wherein it is located within the diameter of the drum 138. This action would also take place were the sheet material 124 is of the same width as the film 34. This feature of the invention prevents the piling up of the film 34 and sheet material 124 upon the projection 146 which would cause a discontinuity in the parallelism between the superposed film and sheet material which could adversely affect the processing of the latent image(s) in the film. Rotation of the cylinder 98 and the drum 138 is continued until the last frame in the film 34 has been withdrawn from the film cassette and superposed with the sheet material 124 upon the drum 138. At this time, a cut out portion at the edge of the film passes over the switch 68 thereby enabling the spring 74 to move it upwardly thereby opening the circuit to the motor 58 and terminating rotation of the cylinder 98 and the drum 138. Also, at this time the indicator 64 goes off and the indicator 66 is lit to indicate the start of a predetermined period of time, e.g., one minute, during which the superposed film 34 and sheet material 124 are to remain in engagement with each upon the drum 138. During or after this predetermined period of time, the user severs the underlying film 34 so as to separate it from its attachment to a film spool located within the film cassette 82. As can be seen in FIG. 2, as the blade 40 enters the recess 78, it engages the pin 76 and moves it downwardly thereby moving the associated switch 68 downwardly into a latched position where it will be located out of the path of movement of the film when it is driven out of the apparatus 10. Also, when the film 34 is severed, the film cassette 82 drops further into the compartment 80, as shown in broken lines in FIG. 2. As the film cassette 82 moves into the broken line positions, the resiliency of the legs 166 of the U-shaped member 168 moves them into a recess 172 in top of the partition 72 where they are in position to guide the severed end of the film 34 through the slot 32.

At the end of the aforementioned predetermined period of time, the indicator 66 goes out. This signals to the operator that the film 34 has been processed to the point where it may be stripped from the sheet material 124 and advanced to the exterior of the apparatus without the ambient light having any deleterious affect upon the processed visible images in the film 34. Accordingly, the operator may now depress the switch 62 which functions to reverse the flow of energy to the motor 58 thereby driving the friction wheels 88, 90, 94 and 144 in a direction opposition to that shown by the arrows in FIG. 2. The counterclockwise rotation of the friction wheels 94 and 144 is transferred to the cylinder 98 and the drum 138 to thereby cause the severed end of the film 34 to move up the arms 166 and toward the slot 32 while the film 34 is being stripped from the sheet material 124. At this point in the processing cycle, the photosensitive layer of the film 34 exhibits a greater adhesion to the sheet material 124 than to the next adjacent layer whereby removal of the sheet material 124 serves to remove the photosensitive layer thus increasing the visual acuity and brightness of the resultant positive color transparency and to enhance its stability by virtue of the removal of residual processing composition in the photosensitive layer. In a particularly preferred embodiment of the film, the aforementioned stripping layer is employed to facilitate the removal of the photosensitive layer. For further details of the film 34, reference may be had to U.S. Pat. No. 3,682,637 granted to Edwin H. Land on Aug. 8, 1972.

In an alternative embodiment of the film, the visible images may be formed in the sheet material rather than in the film. Accordingly, the film would be comprised of a photosensitive layer through which the exposure would be made and a base which may or may not be transparent. Also, the sheet material would be comprised of a transparent base and an image receiving layer. Subsequent to the exposure of the film, the side of the sheet material containing the image receiving layer would be coated with the processing composition 134 and brought into engagement or superposition with the side of the film through which the exposure had been made. After the sheet material had been rewound upon its spool, the roller would be removed and the individual scenes in the sheet material would be cut and mounted for subsequent viewing. In this embodiment, means would be provided for closing the nozzle 132 during rewinding of the sheet material upon its roller 120 to prevent any more processing composition 134 being applied to the sheet material.

As the film 34, containing the visible images, is being advanced to the exterior of the apparatus 10 by the sprocket teeth 100 and 102 and the projection 146, the sheet material is being rewound upon its roller 120 which is, at this time, rotating in a counterclockwise direction under the influence of the spring 128. At the end of the processing cycle, the loading door 30 may be moved to the open position and the kit 16, containing the spreader sheet and any residual processing composition, removed and safely discarded. The processed film may then be cut and mounted in individual frames for subsequent viewing.

Since certain changes may be made in the above apparatus without departing from the scope of the invention herein involved, it is intended that all matter contained in the above description or shown in the accompanying drawings shall be interpreted as illustrative and not in a limiting sense.

What is claimed is:

1. Apparatus for receiving a film cassette containing therein a roll of exposed, instant type transparency film preparatory to processing the film, the cassette including a slot through which an end of the film protrudes, said apparatus comprising:

means for defining a lighttight housing, said means including a door providing access to the interior of said housing;

means for supporting a coiled length of sheet material;

means for severing a strip of film;

means for locating the film cassette containing the exposed roll of instant type transparency film within said housing with its slot adjacent to said severing means;

means for applying a coating of processing composition to the sheet material;

means including a drum for withdrawing the film from the cassette and the sheet material from said supporting means and winding them in superposition upon said drum with a coating of processing composition located therebetween, said withdrawing means including a projection adapted to drivingly engage a sprocket hole in a side of the film to drive the end of the film into a position between the sheet material and the withdrawing means;

means for driving said withdrawing means in a first direction so as to superpose the film and sheet material upon said drum;

means for inactivating said driving means prior to the film being fully withdrawn from the cassette, whereby the film and sheet material may remain in superposition upon said drum until the latent images in the film have been substantially developed; and means for resiliently coupling said projection to said drum for movement from a first operative position wherein it is located outside of the diameter of said drum to a second inoperative position wherein it is located substantially within the diameter of said drum.

2. Apparatus as defined in claim 1 wherein said supporting means includes means, tensioned during the withdrawing of the sheet material therefrom, for biasing said supporting means in a direction so as to rewind the sheet material thereupon, and said driving means includes means for driving said withdrawing means in a second direction, subsequent to the actuation of said severing means, so as to withdraw the film from said drum while said biasing means simultaneously rewinds the sheet material upon said supporting means.

3. Apparatus as defined in claim 2 wherein said housing includes means defining an opening through which the film is adapted to be advanced as it is being removed from said drum, said apparatus further including means for guiding the film toward said opening.

4. Apparatus as defined in claim 1 wherein said supporting means, said coating means, and said drum are mounted within a disposable package which is adapted to be removed from said housing subsequent to the removal of the processed film from said housing.

5. A disposable film processing kit adapted to be located within the housing of a processor for processing an exposed roll of instant type transparency film having sprocket holes therein, said kit comprising:

a housing;

a drum rotatably supported within said housing;

a supply of flexible sheet material coiled upon a roller which is rotatably supported within said housing with one end of said sheet material being secured to said drum;

a container of processing composition having a dispensing end located adjacent a surface of said sheet material;

means for driving said drum so as to withdraw said sheet material from said roller and wind it upon said drum in superposition with the film with a coating of processing composition located between the superposed facing surfaces of said sheet material and the film; and film advancing means, resiliently coupled to said drum, for entering a sprocket hole in the film so as to advance the film into superposition with said sheet material, said film advancing means being adapted for automatic movement into a non-driving position, during processing of the film, whenever it cannot enter a sprocket hole in the film.

6. A disposable film processing kit as defined in claim 5 further including biasing means coupled to said roller, said biasing means being tensioned during the withdrawing of said sheet material from said roller so as to provide a force for driving said roller in a direction to rewind said sheet material upon said roller when said drum is driven in a direction so as to unwind the film and said sheet material therefrom.

7. A disposable film processing kit as defined in claim 5 wherein said housing includes an opening through which said film advancing means is adapted to extend.

* * * * *